US008349096B2

(12) United States Patent
Kosaka et al.

(10) Patent No.: US 8,349,096 B2
(45) **Date of Patent: *Jan. 8, 2013**

(54) TITANIUM ALLOY AND AUTOMOTIVE EXHAUST SYSTEMS THEREOF

(75) Inventors: Yoji Kosaka, Henderson, NV (US); Stephen P. Fox, Henderson, NV (US)

(73) Assignee: Titanium Metals Corporation, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/848,872

(22) Filed: Aug. 2, 2010

(65) Prior Publication Data

US 2011/0027121 A1 Feb. 3, 2011

Related U.S. Application Data

(63) Continuation of application No. 12/315,773, filed on Dec. 5, 2008, now Pat. No. 7,767,040, which is a continuation of application No. 10/460,233, filed on Jun. 13, 2003, now abandoned.

(60) Provisional application No. 60/390,145, filed on Jun. 21, 2002.

(51) Int. Cl.
*C22C 14/00* (2006.01)

(52) U.S. Cl. ..... 148/421; 420/417; 420/418; 181/212

(58) Field of Classification Search ..... 148/421; 420/417, 418; 181/212

See application file for complete search history.

(56) References Cited

U.S. PATENT DOCUMENTS

| | | | |
|---|---|---|---|
| 4,738,822 | A | 4/1988 | Banis |
| 4,871,400 | A | 10/1989 | Shindo et al. |
| 5,885,375 | A | 3/1999 | Takemura et al. |
| 6,531,091 | B2 | 3/2003 | Miyamoto et al. |
| 2005/0202271 | A1 | 9/2005 | Yashiki et al. |

FOREIGN PATENT DOCUMENTS

| | | | |
|---|---|---|---|
| JP | 02141554 A | * | 5/1990 |
| JP | 10017961 | | 1/1998 |
| JP | 10146456 | | 12/1999 |
| JP | 11267954 | | 4/2001 |
| JP | 2003055725 | | 2/2003 |
| WO | WO9737049 | | 10/1997 |

OTHER PUBLICATIONS

"ASM Handbook: vol. 2 Properties and Selection: Nonferrous Alloys and Special-Purpose Materials", ASM International, 1990, pp. 592-594, 608-610.

A.M. Sherman, C.J. Sommer, & F.H. Froes, Ford Motor Co., Res Lab. "The Use of Titanium in Production Automobiles: Potential and Challenges", *Journal of the Minerals Metals & Materials Society*, 1997.

A.M. Chaze, G. Beranger, & C. Coddet. "A Comparison of the influence of Si, Al, and Cr additions on the high temperature oxidation behaviour of titanium" *Titanium and Science Technology*, 1984, pp. 2665-2672.

R. Boyer, G. Welsch, E.W. Coltings. "Materials Properties Handbook: Titanium Alloys", 1994.

* cited by examiner

*Primary Examiner* — Roy King
*Assistant Examiner* — Janelle Morillo
(74) *Attorney, Agent, or Firm* — Locke Lord, LLP

(57) ABSTRACT

An oxidation resistant, high strength titanium alloy, particularly adapted for use in the manufacture of automotive exhaust system components and other applications requiring oxidation resistance and strength at elevated temperatures. The alloy comprises, in weight percent, iron less than 0.5, or 0.2 to less than 0.5%, oxygen 0.02 to less than 0.15%, silicon 0.15 to 0.6%, and balance titanium. Optional alloying elements are Al, Nb, V, Mo, Sn, Zr, Ni, Cr and Ta, with a total content of less than 1.5.

18 Claims, 1 Drawing Sheet

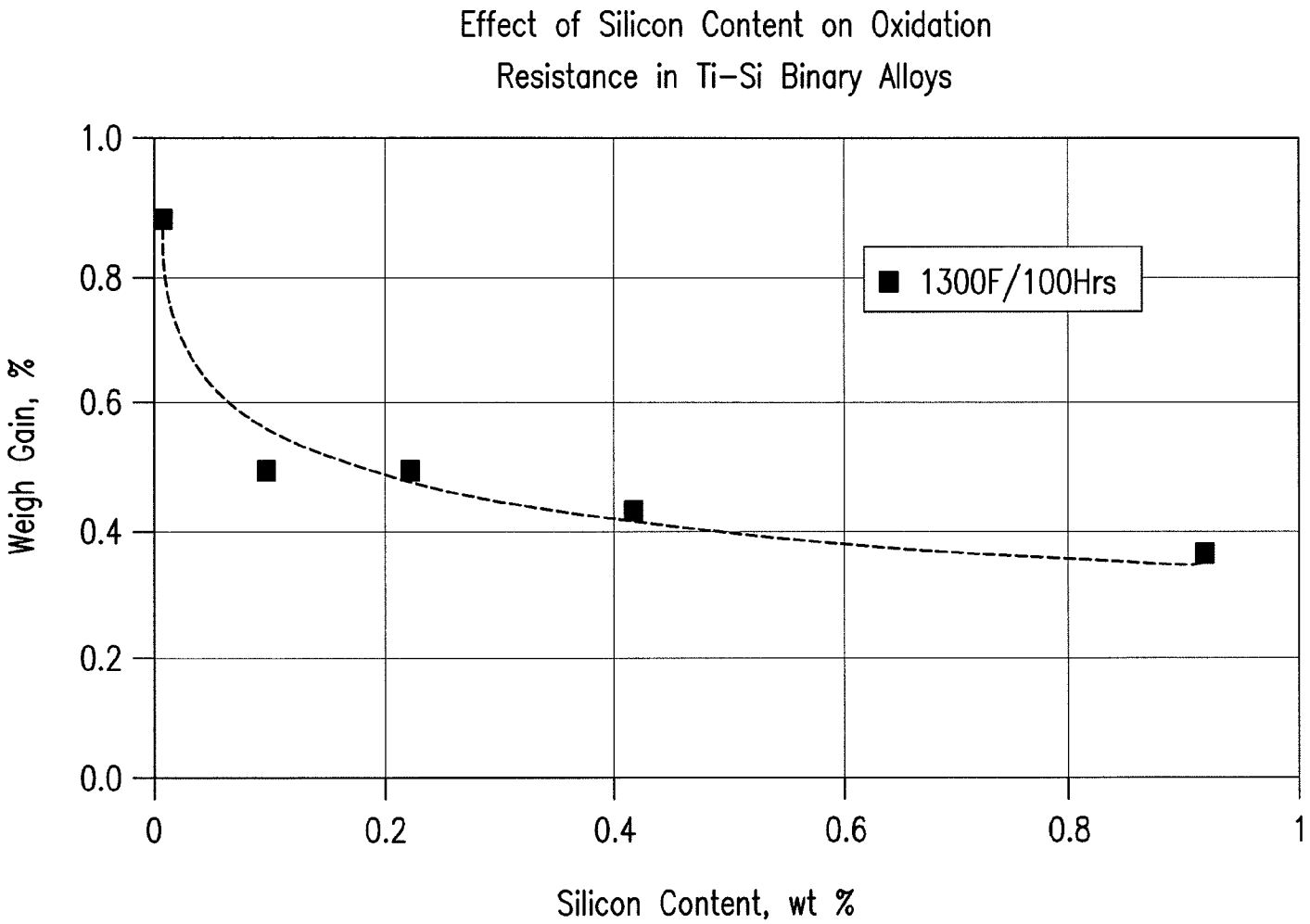
Effect of Silicon Content on Oxidation
Resistance in Ti-Si Binary Alloys
1300F/100Hrs
Weigh Gain, %
1.0
0.8
0.6
0.4
0.2
0.0
0
0.2
0.4
0.6
0.8
1
Silicon Content, wt %

TITANIUM ALLOY AND AUTOMOTIVE EXHAUST SYSTEMS THEREOF

CROSS-REFERENCE TO RELATED APPLICATION

This application is a continuation of U.S. application Ser. No. 12/315,773 (now U.S. Pat. No. 7,767,040) filed Dec. 5, 2008, which is a continuation of U.S. application Ser. No. 10/460,233, filed Jun. 13, 2003, ABN, which claims priority under 35 U.S.C. §119(e) to U.S. Provisional Application No. 60/390,145 filed Jun. 21, 2002, all of which are herein incorporated by reference.

DESCRIPTION OF THE INVENTION

1. Field of the Invention

The invention relates to an oxidation resistant, high strength titanium alloy which may in the form of a flat rolled or coiled strip product. The alloy is advantageously used for automotive exhaust system components, wherein elevated temperature strength and oxidation resistance is a required combination of properties.

2. Background of the Invention

It is known to use commercially pure (CP) titanium for automotive exhaust systems and mufflers for motorcycles. These exhaust systems made of CP titanium are lighter than those made from standard stainless steel. Weight reductions when using titanium to replace stainless steel may be as high as 44%, which is equivalent to approximately 20 lbs. of weight reduction for the system.

The use of CP titanium in exhaust systems to benefit from the weight reduction results in commercially pure titanium exhibiting excessive oxidation and softening during this high temperature service application. Consequently, the use of CP titanium sheet product has been limited to specific components of exhaust systems that are exposed to relatively low temperatures.

Consequently, there is a demand from both the automotive and exhaust system manufacturers for a titanium alloy sheet product that can be used at higher temperatures than CP titanium sheet product. The critical properties for this product are oxidation resistance and elevated temperature strength at temperatures up to 1600 F. In addition, since this sheet product requires a forming and fabricating operation to produce the various exhaust system components, cold formability and weldability are required close to these properties exhibited by CP titanium.

SUMMARY OF THE INVENTION

In accordance with the invention, an oxidation resistant, high strength titanium alloy comprises, in weight %, less than 0.5 iron, 0.02 to less than 0.15 oxygen, 0.15 to 0.6 silicon and balance titanium and incidental impurities. Iron may be present within the range of 0.2 to less than 0.5%.

The alloy may include at least one element of Al, Nb, V, Mo, Sn, Zr, Ni, Cr and Ta in a total amount of less than 1.5%.

The alloy preferably has a minimum UTS of 7 ksi upon testing at a temperature of 1400 F, in combination with resistance to oxidation at 1400 F for 100 hours of less than 1% weight gain.

The alloy may be in the form of a flat rolled product or a coil strip product.

The alloy may be in the form of an automotive exhaust system component, which may be a muffler.

With respect to the alloy composition in accordance with the invention, silicon is the most important alloying element.

Silicon is known to be effective in titanium alloys to improve strength and creep resistance at elevated temperatures. Silicon is also effective to suppress grain growth during long time exposure at elevated temperatures. If the content of silicon is too low, the effect will not be sufficient in this regard. On the other hand, if the content is too great, formability of resulting sheet product of the alloy will be deteriorated.

Oxygen is an effective strengthening element in titanium alloys at ambient temperatures, but has little affect on the oxidation and strength at elevated temperatures. In accordance with the invention, if the content of oxygen is too low, the cost of the titanium sheet of the alloy will increase, because scrap metal will not be suitable for use in the melting of the alloy. On the other hand, if the content is too great, formability will be deteriorated.

Iron is a strengthening element in titanium at ambient temperatures, but has a slightly inverse affect on oxidation. If, however, the iron content exceeds the upper limits in accordance with the invention, there will potentially be a segregation problem and ductility and formability will consequently be reduced. On the other hand, having iron at an extremely low level will result in excessive raw material costs.

The elements Al, Nb, V, Mo, Sn, Zr, Ni, Cr, Cu and Ta may be present in the alloy in accordance with the invention to improve specific properties. A total content of these elements is less than 1.5%.

BRIEF DESCRIPTION OF THE DRAWINGS

FIG. 1 is a graph showing the effect of silicon on oxidation resistance in Ti—Si binary alloys.

DETAILED DESCRIPTION AND SPECIFIC EXAMPLES

Example 1

Button arc melt ingots each weighing approximately 225 grams were made. The chemical composition of each button is given in Table 1. The buttons were forged and hot rolled to sheets with about 0.12" thickness. The sheets were then cold rolled to about 0.050" followed by annealing at 1400 F for 10 minutes. After flash pickle to clean the surface, coupons were cut for oxidation tests and tensile tests at both ambient and elevated temperatures. The oxidation tests were performed at 1300 F/100 hours in air. The results of the tests are summarized in Table 2. The invention alloys, C and D, exhibited higher strength than commercially pure titanium (CP Ti) particularly at elevated temperatures. This is due to the silicide precipitates in these alloys. The 3% aluminum containing alloys, A, B, E and F, show good oxidation resistance and strength. However, their ductility is not as good as invention alloys.

Microstructural observations of the oxidized samples indicated that the alloys that did not contain silicon exhibited substantial grain coarsening after being exposed at high temperatures for long periods of time. These coarse grains could potentially cause brittleness. In contrast, the silicon-containing alloys maintained relatively finer grains due to the pinning effect of silicides and the beta phase.

TABLE 1

Chemical Composition of Test Materials (wt %)

| Alloy | Alloy Type | Al | Fe | Si | Nb | 0 | Remarks |
|---|---|---|---|---|---|---|---|
| A | Ti—0.5Si—3Al—1Nb | 3.0 | 0.07 | 0.42 | 1.0 | 0.12 | Comparison |
| B | Ti—0.5Si—3Al | 3.0 | 0.06 | 0.40 | — | 0.12 | Comparison |
| C | Ti—0.5Si—1Nb | 0.01 | 0.06 | 0.44 | 1.0 | 0.12 | Invention |
| D | Ti—0.5Si | 0.01 | 0.07 | 0.42 | — | 0.12 | Invention |
| E | Ti—3Al—1Nb | 2.9 | 0.22 | 0.01 | 0.9 | 0.11 | Comparison |
| F | Ti—3Al | 3.0 | 0.06 | 0.01 | — | 0.11 | Comparison |
| G | Ti—1Nb | 0.02 | 0.08 | 0.01 | 1.0 | 0.11 | Comparison |
| H | CP Ti | 0.01 | 0.06 | 0.01 | — | 0.10 | Comparison |
| Production Sheet Grade 2 | | — | 0.07 | 0.01 | — | 0.14 | Comparison |
| Production Sheet Grade 12 | | 0.01 | 0.13 | 0.02 | — | 0.11 | Comparison Ni: 0.89, Mo: 0.28 |

TABLE 2

Results of Mechanical and Oxidation Tests

| Alloy | Alloy Type | UTS (RT) ksi | YS (RT) ksi | EI (RT) % | UTS (800° F.) ksi | Bend Radius (T) | Oxidation WG (%) | Oxidation ASTM GS No. | Oxidation GS (μm) | Remarks |
|---|---|---|---|---|---|---|---|---|---|---|
| A | Ti—0.5Si—3Al—1Nb | 86.8 | 80.2 | 19 | 52.0 | 6.5 | 0.29 | 9.0 | 15.9 | Comparison |
| B | Ti—0.5Si—3Al | 88.6 | 80.8 | 23 | 50.6 | 2.2 | 0.35 | 7.5 | 26.7 | Comparison |
| C | Ti—0.5Si—1Nb | 76.7 | 72.3 | 28 | 38.2 | 0.3 | 0.44 | 9.0 | 15.9 | Invention |
| D | Ti—0.5Si | 75.9 | 69.3 | 28 | 38.5 | 0.2 | 0.44 | 9.5 | 13.3 | Invention |
| E | Ti—3Al—1Nb | 76.5 | 67.7 | 27 | 38.3 | 2.0 | 0.63 | 5.0 | 63.5 | Comparison |
| F | Ti—3Al | 75.7 | 67.1 | 24 | 38.6 | 2.1 | 0.45 | 5.5 | 53.4 | Comparison |
| G | Ti—1Nb | 60.8 | 47.8 | 32 | 21.1 | 0.3 | 0.62 | 5.0 | 63.5 | Comparison |
| H | CP Ti | 56.2 | 43.4 | 36 | 19.5 | 0.3 | 0.89 | 3.5 | 106.8 | Comparison |
| Production Sheet Grade 2 | | 75.3 | 54.2 | 27 | 28.9 | 0.8 | 0.83 | 3.5 | 106.8 | Comparison |
| Production Sheet Grade 12 | | 84.4 | 59.4 | 27 | 49.1 | 0.6 | 1.14 | 10.0 | 11.2 | Comparison |

Example 2

Additional button arc melted ingots each weighing approximately 225 grams were made. The chemical composition of each button is given in Table 3. The buttons were forged and hot rolled to sheets of about 0.12" thickness. Then the sheets were cold rolled to about 0.050" followed by annealing at 1400 F for 10 minutes. After a flash pickle to clean the surface, coupons were cut for oxidation testing and tensile testing at both ambient and elevated temperatures. Oxidation testing was performed at 1300 F/100 hours. Selected samples were subject to the additional oxidation testing at 1500 F/100 hours, which is considered to be a severe condition in automotive exhaust system applications.

The test results are summarized in Table 4. These test results show that the strength at room temperature or elevated temperature increased with increases in silicon content. Also weight gain after the exposure in air at 1300 F for 100 hours decreases with increases in silicon content. This is also shown in FIG. 1. Oxidation testing at a much higher temperature of 1500 F indicated that the alloys with silicon contents less than 0.15% (Alloy O or P) did not exhibit equivalent oxidation resistance to those with higher silicon alloys (Alloy M or N).

TABLE 3

Chemical Composition of Test Materials (wt %)

| Alloy | Alloy Type | Al | Fe | Si | Sn | O | Remarks |
|---|---|---|---|---|---|---|---|
| I | Ti—0.1Si | 0.02 | 0.11 | 0.10 | — | 0.15 | Comparison |
| J | Ti—0.25Si | 0.02 | 0.13 | 0.23 | — | 0.21 | Comparison |
| K | Ti—1Si | 0.02 | 0.11 | 0.92 | — | 0.17 | Comparison |
| L | Ti—0.5Fe | 0.02 | 0.59 | 0.01 | — | 0.18 | Comparison |
| M | Ti—0.5Si—0.25Fe-Low O | — | 0.24 | 0.42 | — | 0.12 | Invention |
| N | Ti—0.5Si—0.25Fe-High O | — | 0.27 | 0.46 | — | 0.20 | Comparison |
| O | Ti—0.15Si—0.25Fe-Low O | — | 0.26 | 0.14 | — | 0.13 | Comparison |
| P | Ti—0.15Si—0.25Fe-High O | — | 0.19 | 0.09 | — | 0.23 | Comparison |
| Q | Ti—0.5Si—1Sn | — | 0.03 | 0.46 | 0.96 | 0.11 | Invention |
| R | Ti—1Sn | — | 0.03 | 0.01 | 0.97 | 0.14 | Comparison |

The oxidation test also indicated that a sole addition of iron or tin without silicon did not show any benefit in terms of oxidation resistance (Alloy L or R). However, the addition of iron or tin with the addition of silicon showed equivalent oxidation resistance (Alloy M, N, O, P and Q). The effect of oxygen was mixed regarding strength. The strength at room temperature increases with oxygen (compare alloy M and N or O and P), but there was no affect on the strength or oxidation resistance at elevated temperatures.

TABLE 4

Results of Mechanical and Oxidation Tests
(Duration of oxidation test is 100 hours at given temperatures)

| Alloy | Alloy Type | UTS (RT) ksi | YS (RT) ksi | EI (RT) % | UTS (800° F.) ksi | Weight Gain (%) 1300 F. | Weight Gain (%) 1500 F. | Remarks |
|---|---|---|---|---|---|---|---|---|
| I | Ti—0.1Si | 78.1 | 64.3 | 28 | 29.1 | 0.51 | n/a | Comparison |
| J | Ti—0.25Si | 82.0 | 70.3 | 34 | 34.4 | 0.51 | n/a | Comparison |
| K | Ti—1Si | 94.3 | 82.8 | 24 | 46.6 | 0.36 | n/a | Comparison |
| L | Ti—0.5Fe | 87.9 | 71.5 | 27 | 34.2 | 0.83 | n/a | Comparison |
| M | Ti—0.5Si—0.25Fe-Low O | 80.3 | 72.7 | 25 | 42.3 | 0.40 | 1.56 | Invention |
| N | Ti—0.5Si—0.25Fe-High O | 89.8 | 80.1 | 27 | 40.9 | 0.41 | 1.59 | Comparison |
| O | Ti—0.15Si—0.25Fe-Low O | 72.0 | 61.6 | 22 | 32.9 | 0.52 | 2.59 | Comparison |
| P | Ti—0.15Si—0.25Fe-High O | 86.0 | 74.7 | 20 | 31.7 | 0.49 | 2.25 | Comparison |
| Q | Ti—0.5Si—1Sn | 75.6 | 67.3 | 25 | 36.5 | 0.28 | 2.78 | Invention |
| R | Ti—1Sn | 63.2 | 48.7 | 28 | 20.5 | 0.81 | 13.9 | Comparison |

Example 3

Two alloy ingots each of about 18 lbs. were made with a laboratory VAR (Vacuum Arc Remelting) furnace. The ingots were made with a double VAR process, which is frequently used in the production of titanium ingots. The ingots were forged to 1.0" thick plates, followed by hot rolling to 0.125" thick plates. After blast and pickle to remove scale and alpha case, the plates were cold rolled to 0.050" thick sheets followed by annealing at 1400 F/10 min. and flash pickle. The sheets were produced without any hot or cold rolling problems. Table 5 shows the chemical composition of these alloys. Various tests were performed on the sheets to verify the superiority in properties required for automotive exhaust materials compared to CP titanium Grade 2.

TABLE 5

Chemical Composition of Test Materials (wt %)

| Alloy | Alloy Type | Si | Fe | C | O | N | Remarks |
|---|---|---|---|---|---|---|---|
| S | Ti—0.5Si | 0.54 | 0.13 | 0.06 | 0.11 | 0.001 | Invention |
| T | Ti—0.5Si—0.5Fe | 0.42 | 0.49 | 0.05 | 0.10 | 0.002 | Invention |
| | Prod. Sheet Grade 2 | 0.01 | 0.07 | 0.01 | 0.14 | 0.008 | Comparison |

The results of oxidation tests are given in Table 6. It is evident from the results that the invented alloys exhibited oxidation resistance superior to CP titanium at all temperatures. The difference in the oxidation resistance between the invented alloy sheets and CP titanium sheet increases with temperature. Table 7 shows the results of the tensile tests. These tests demonstrate that the invented alloy sheets exhibited higher strength than CP titanium sheet at all temperatures.

Welding is employed in the production of exhaust tubes and other components, and in the assemble of exhaust systems. Both autogenous welding and welding with filler metal are used. Table 8 shows the results of tensile testing after welding with gas tungsten arc welding (GTAW). A CP titanium wire was used for filler metal. Although the microstructure of the weldment and part of heat affected zone exhibited a transformed beta microstructure with coarse grains, the welds had sufficiently high strength with an acceptable ductility.

TABLE 6

Results of Oxidation Test
(weight gain % after exposure in air for 100 hours at given temperature)

| Alloy | Alloy Type | 1300 F. | 1400 F. | 1500 F. | 1600 F. | Remarks |
|---|---|---|---|---|---|---|
| S | Ti—0.5Si | 0.58 | 0.70 | 1.66 | 3.18 | Invention |
| T | Ti—0.5Si—0.5Fe | 0.49 | 0.73 | 1.93 | 4.25 | Invention |
| | Prod. Sheet Grade 2 | 1.03 | 3.01 | 20.02 | 37.14 | Comparison |

TABLE 7

Results of Tensile Tests at Room Temperature and Elevated Temperatures

| | | RT | | 800 F. | | 1400 F. | | |
|---|---|---|---|---|---|---|---|---|
| Alloy | Alloy Type | UTS ksi | YS ksi | UTS ksi | YTS ksi | UTS ksi | YS ksi | Remarks |
| S | Ti—0.5Si | 81.7 | 74.8 | 42.6 | 37.1 | 9.1 | 8.9 | Invention |
| T | Ti—0.5Si—0.5Fe | 84.3 | 76.1 | 45.4 | 37.9 | 9.2 | 9.0 | Invention |
| Prod. Sheet Grade 2 | | 68.2 | 55.9 | 25.9 | 22.2 | 5.7 | 5.7 | Comparison |

TABLE 8

RT Tensile Properties of Welded Sheets

| | | With Filler Metal | | | Without Filler Metal | | | |
|---|---|---|---|---|---|---|---|---|
| Alloy | Alloy Type | UTS ksi | YS ksi | EI % | UTS ksi | YS ksi | EI % | Remarks |
| S | Ti—0.5Si | 89.9 | 69.9 | 9 | 92.8 | 78.0 | 12 | Invention |
| T | Ti—0.5Si—0.5Fe | 96.9 | 83.8 | 7 | 98.6 | 82.0 | 10 | Invention |

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

All percentages are in percent by weight in both the specification and claims.

What is claimed is:

1. A titanium alloy consisting of, in weight %, iron 0.06 to 0.5, oxygen 0.02 to 0.12%, silicon 0.15 to 0.46%, and balance titanium with incidental impurities, wherein the titanium alloy has a mean grain size of 15.9 μm or less.

2. A titanium alloy consisting of, in weight %, iron 0.06 to 0.5, oxygen 0.02 to 0.12%, silicon 0.15 to 0.46%, at least one element selected from the group consisting of Al, Nb, V, Mo, Sn, Zr, Ni, Cr and Ta, with a total content of less than 1.5, and balance titanium with incidental impurities, wherein the titanium alloy has a mean grain size of 15.9 μm or less.

3. The titanium alloy according to claim 1, wherein the iron is 0.07%, the oxygen is 0.12%, and the silicon is 0.42%.

4. The titanium alloy according to claim 2, wherein the iron is 0.06%, the oxygen is 0.12%, the silicon is 0.44%, and the Nb is 1.0%.

5. The titanium alloy according to claim 1, wherein the iron is 0.24%, the oxygen is 0.12%, and the silicon is 0.42%.

6. A flat rolled product comprising the titanium alloy according to claim 1.

7. A cold rolled product comprising the titanium alloy according to claim 1.

8. A coil strip product comprising the titanium alloy according to claim 1.

9. An automotive exhaust system component comprising a titanium alloy consisting of, in weight %, iron 0.06 to 0.5, oxygen 0.02 to 0.12%, silicon 0.15 to 0.6%, and balance titanium with incidental impurities, wherein the titanium alloy has a mean grain size of 15.9 μm or less.

10. An automotive exhaust system component comprising a titanium alloy consisting of, in weight %, iron 0.06 to 0.5, oxygen 0.02 to 0.12%, silicon 0.15 to 0.6%, at least one element selected from the group consisting of Al, Nb, V, Mo, Sn, Zr, Ni, Cr and Ta, with a total content of less than 1.5, and balance titanium with incidental impurities, wherein the titanium alloy has a mean grain size of 15.9 μm or less.

11. The automotive exhaust system component according to claim 9, wherein the iron is 0.07%, the oxygen is 0.12%, and the silicon is 0.42%.

12. The automotive exhaust system component according to claim 10, wherein the iron is 0.06%, the oxygen is 0.12%, the silicon is 0.44%, and the Nb is 1.0%.

13. The automotive exhaust system component according to claim 9, wherein the iron is 0.24%, the oxygen is 0.12%, and the silicon is 0.42%.

14. A muffler comprising a titanium alloy consisting of, in weight %, iron 0.06 to 0.5, oxygen 0.02 to 0.12%, silicon 0.15 to 0.6%, and balance titanium with incidental impurities, wherein the titanium alloy has a mean grain size of 15.9 μm or less.

15. A muffler comprising a titanium alloy consisting of, in weight %, iron 0.06 to 0.5, oxygen 0.02 to 0.12%, silicon 0.15 to 0.6%, at least one element selected from the group consisting of Al, Nb, V, Mo, Sn, Zr, Ni, Cr and Ta, with a total content of less than 1.5, and balance titanium with incidental impurities, wherein the titanium alloy has a mean grain size of 15.9 μm or less.

16. The muffler according to claim 14, wherein the iron is 0.07%, the oxygen is 0.12%, and the silicon is 0.42%.

17. The muffler according to claim 15, wherein the iron is 0.06%, the oxygen is 0.12%, the silicon is 0.44%, and the Nb is 1.0%.

18. The muffler according to claim 14, wherein the iron is 0.24%, the oxygen is 0.12%, and the silicon is 0.42%.

* * * * *